United States Patent [19]

Scheck et al.

[11] Patent Number: 4,744,125

[45] Date of Patent: May 17, 1988

[54] DOOR CLOSER TRANSMISSION INCLUDING AN ECCENTRIC PINION

[75] Inventors: Georg Scheck, Tiefenbronn; Ralf Storandt, Leonberg; Fritz Feucht, Renningen, all of Fed. Rep. of Germany

[73] Assignee: GEZE GmbH, Fed. Rep. of Germany

[21] Appl. No.: 881,819

[22] Filed: Jul. 3, 1986

[30] Foreign Application Priority Data

Jul. 5, 1985 [DE] Fed. Rep. of Germany ..... 3524185
Apr. 28, 1986 [EP] European Pat. Off. ..... 86105855.0

[51] Int. Cl.[4] ..... E05F 3/14

[52] U.S. Cl. ..... 16/53; 16/62; 16/64; 16/DIG. 9; 16/DIG. 10

[58] Field of Search ..... 16/52, 53, 58, 62, 64, 16/69, 79, DIG. 9, DIG. 10

[56] References Cited

U.S. PATENT DOCUMENTS

| | | | |
|---|---|---|---|
| 1,253,369 | 1/1918 | Gair | 16/62 |
| 3,220,047 | 11/1965 | Flint | 16/62 |
| 3,337,902 | 8/1967 | Webb et al. | 16/62 |

FOREIGN PATENT DOCUMENTS

| | | | |
|---|---|---|---|
| 0056256 | 7/1982 | European Pat. Off. | 16/52 |
| 3234319 | 3/1984 | Fed. Rep. of Germany | 16/52 |
| 1332480 | 10/1973 | United Kingdom | 16/58 |

*Primary Examiner*—Fred Silverberg

[57] ABSTRACT

A door closer is described in which transmission characteristics which change in dependence on the closing angle can be realized either by two pistons disposed coaxially within one another and displaceable relative to one another, or by eccentric toothed elements.

6 Claims, 8 Drawing Sheets

DOOR CLOSER TRANSMISSION INCLUDING AN ECCENTRIC PINION

Figure 1:
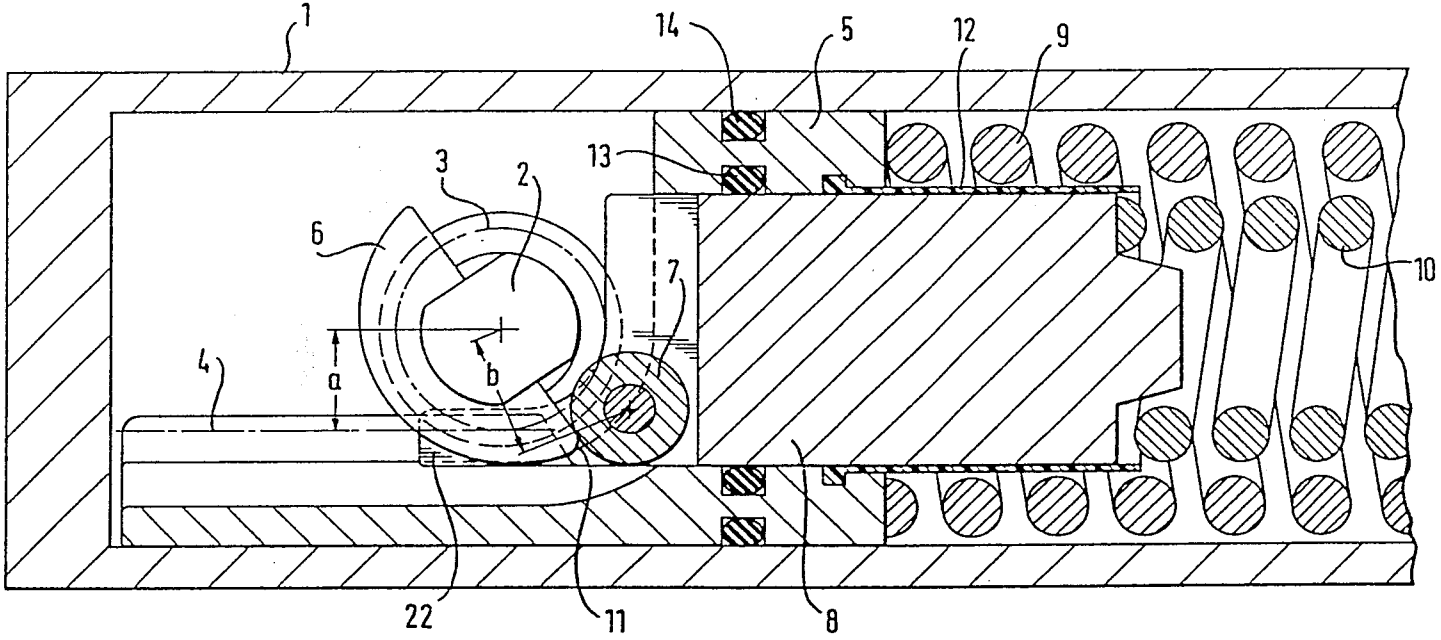

The invention relates to a door closer comprising a piston arrangement guided in a housing and mechanically coupled with a rotatably journalled closer axle; at least one closer spring cooperating with the piston arrangement; and a hydraulic damping device.

A closer of this kind is known from German Gebrauchsmuster No. 17 95 135.

This known closer is constructed in such a way that the torque acting on the closer axle has its maximum in the zero position, reduces rapidly in the region of small angles of opening, then remains approximately constant and finally sinks gradually to zero at an angle of opening of 180°. This is achieved in that the closing spring is guided on a hollow cylinder which is fixedly arranged in the closer housing, with respective slide members serving as abutments for the spring being displaceable in slots at each end of the hollow cylinder. The Slide member facing the closer axle contacts a cam disk sitting on the closer axle by means of a roller. "Rotation of the closer axle is converted into sliding of the other slide member via a chain drive and crank mechanism and serves to additionally compress the closer spring.

This known apparatus is on the one hand extremely complicated and offers, on the other hand, only little scope with regard to the selection of a specific closing force characteristic, plot or function, i.e. a specific variation of the closing force relative to the angle of opening of the door.

Particular attention must be paid in practice to the transmission ratio of the respective closer, i.e. to the instantaneous ratio of the angular speed of the closer axle relative to the angular speed of the door, particularly when special requirements are placed on the closure; be it a door closer mounted at the top of the door installation or a floor-mounted door closer. This is for example the case with so-called slide arm closers in which the closing moments are unfavourable because only a comparatively small moment is available at small closing angles when the door has to be pressed into the lock. Although with slide arm closers, which are characterised by an optically favourable appearance, the friction ratio is favourable at the instant of opening the door leaf, because little friction occurs at small angles of opening, relatively long guide rails must always be tolerated in order to ensure the required operational reliability.

The object underlying the invention is to provide a door closer which can be used both as a door closer for overhead mounting, as a floor-mounted door closer and in particular as a slide arm closer, and which is economical to manufacture and provides ideal closing moments in operation. Accordingly, with slide arm closers, the invention will permit the use of short guide rails, the dimensions of which correspond approximately to the dimensions of the closer.

This object is satisfied in accordance with a first embodiment of the invention essentially in that the piston arrangement consists of two pistons which are coaxial to one another and displaceable relative to one another, with the pistons being braced via at least one compression spring against an abutment fixed on the housing, in particular an adjustable abutment; and in that these two pistons are coupled with the closer axle by means of separate transmission elements which have different transmission ratio functions or transmission characteristics.

As a result of the pistons which can be loaded against the respective spring forces by different mechanical advantages or transmission ratios, which can be predetermined in defined manner in dependence on the angle of opening, it is possible to vary the prevailing total closing moment which is effective within wide ranges because the total closing moment results from the addition of the individual closing moments associated with the two pistons. Thus, for example a proportionally rising closing moment can be combined with a closing moment which is high at small angles of opening and which then drops off in a predeterminable manner. In this way a correspondingly high total closing moment can e.g. be selected in the region of a small angle of opening and this total closing moment can then be reduced to a lower closing moment which is however substantially constant over the entire angle of opening.

When using the closer of the invention for slide arm closers, a total closing moment can be generated through the combination of the closing moments originating from the two pistons which even provides a completely satisfactory closing force characteristic, when the closer axle is arranged relatively close to the pivot bearing on the door. Accordingly, it is possible to use surprisingly short guide rails which results in a particularly favourable optical appearance.

The two pistons are preferably respectively braced via a coil spring against an abutment fixed relative to the housing, in particular an adjustable abutment. Even when the bias of the two springs is changed via the adjustable abutment the total characteristic determined by the transmission elements is retained.

In accordance with one embodiment of the invention, which is particularly advantageous for a floor-mounted door closer, the closer axle is arranged in a corner region of the housing and is coupled with the transmission elements having different transmission characteristics via a gear wheel fixed to the axle. This arrangement makes an extremely low k-value possible, with the small transverse dimension being of particular importance. The gear wheel associated with the closer axle can then be displaced directly to the edge of the housing and it is also possible to use different gear wheels in order to vary the force plot which is achieved. By way of example the sideways k-dimension with floor-mounted door closer for rabbeted doors can amount to 20 mm.

A variant of the invention for solving the stated problem which is characterised by its particular simplicity and operational reliability has at least one eccentric toothed pinion which engages in a complementary toothed arrangement which is at least associated in force-transmitting manner with the piston. In this arrangement the rolling curve of the pinion connected to the closer axle passes, starting from a region with a minimum radius continuously into a region with a maximum radius; and the piston-side toothed arrangement associated with the toothed pinion extends along an elongated S-shaped rolling curve.

As a result of the continuously present engagement between the toothed pinion and the toothed arrangement at the piston side it is ensured that all movements take place exactly synchronously with the piston, and thus that no form of problems occur, for example when slamming a door to.

As a result of the flat, i.e. elongated shape of the rolling curve of the piston-side toothed arrangement, which is S-shaped in the basic configuration, a small angle of engagement is achieved at the same time as a transmission ratio which is as large as possible. The frictional losses which occur can thus be kept extremely small with this arrangement.

A development of the invention which is particularly compact, which is economical to manufacture and which is highly reliable in operation is characterised in that the piston-side toothed arrangement is formed by a toothed rack-like extension of the piston; and in that this extension forms in particular a wall portion of the piston which is executed as a hollow piston, with the pinion being arranged in the hollow chamber of the piston.

In an embodiment of the invention which is particularly suited for floor-mounted door closers the closer axle is arranged in a corner region of the housing and is coupled via two eccentric pinions with the toothed arrangement associated with the piston. In this manner very different transmission ratios can be achieved with an extremely compact construction, without having to accept penalties with regard to the operability and operational reliability or operating life.

In accordance with a further embodiment of the invention which is especially suited to generate the two-sided closing movement required for swinging doors, the closer axle is coupled via an eccentric pinion with a toothed segment which is of centrally symmetric construction, which is pivotally mounted, and which is pivotally connected to the piston via a connecting member, and the piston is spring-biased on both sides with reference to a central position corresponding to the closed position.

Finally, in a further embodiment of the invention, which is specially suited for rabbeted doors (in German "Anschlagtüren"), the closer axle is again preferably arranged in a corner region of the housing and is connected with an eccentric pinion. The eccentric pinion is connected with the piston via an eccentric toothed segment, the pivotal axis of which is located in the half of the housing opposite to the closer axle, and also via a connecting member which is pivotally connected to this toothed segments. The piston is biased by a spring against a first abutment and is movable up to a second fixed abutment.

Further advantageous embodiments of the invention are set forth in the subordinate claims.

Figure 2:
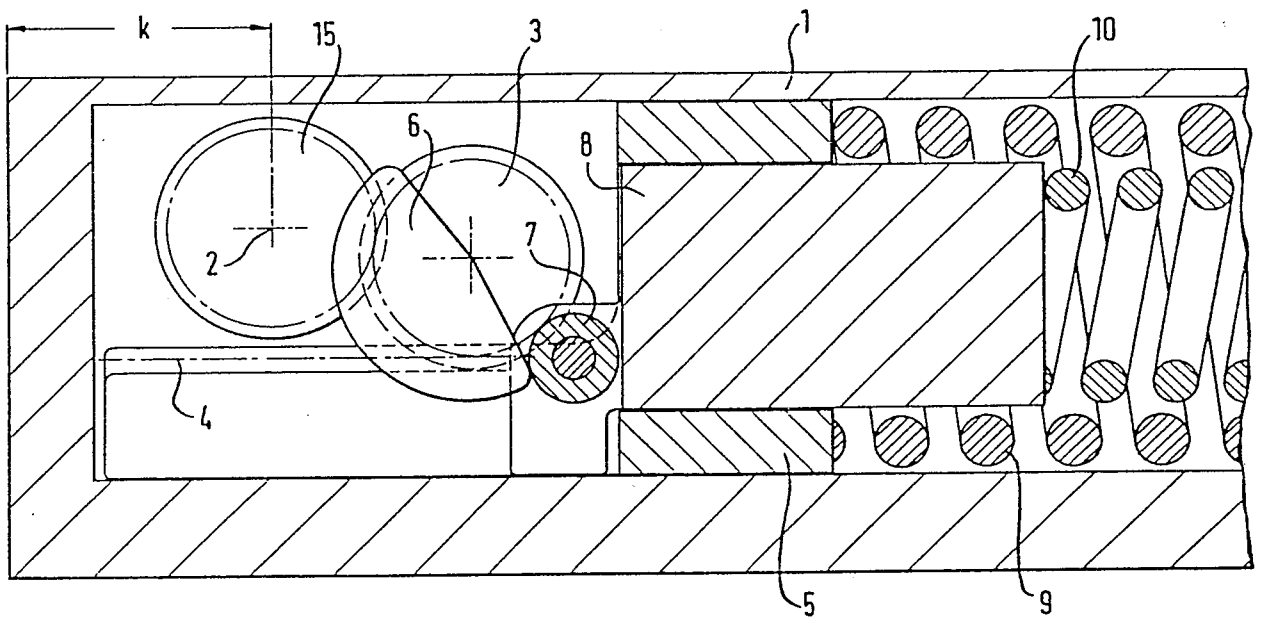
Figure 3:
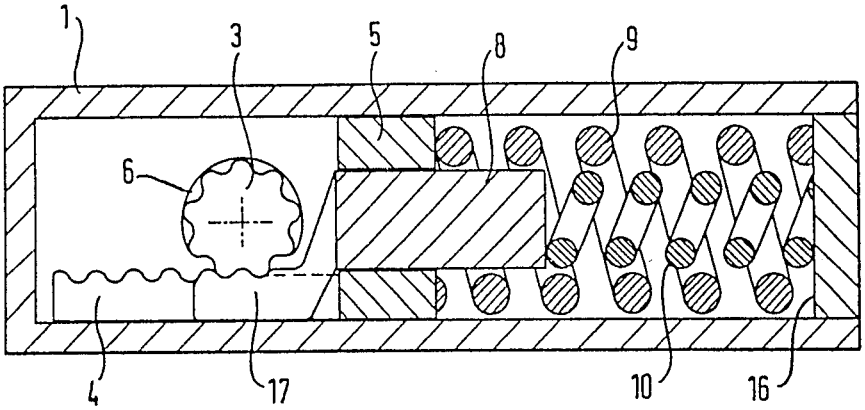
Figure 4:
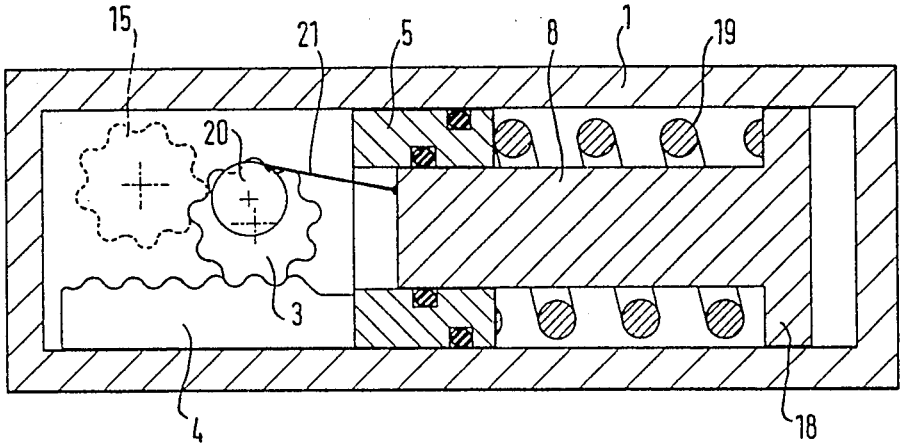
Figure 5:
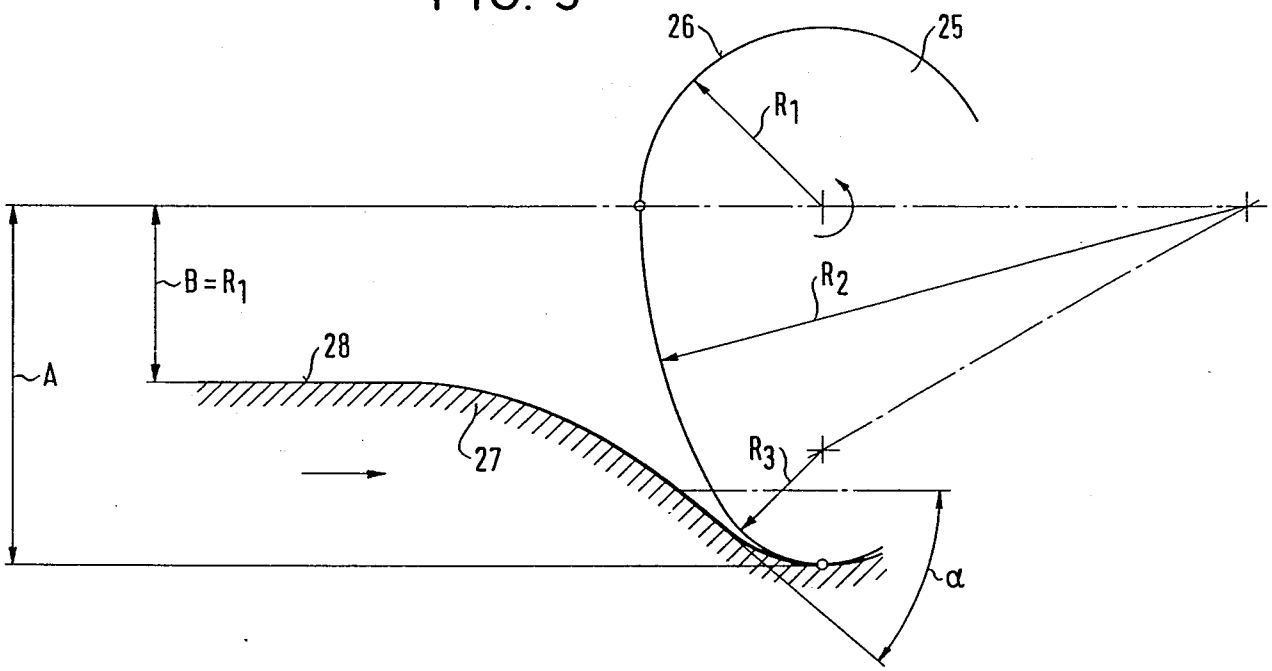
Figure 6:
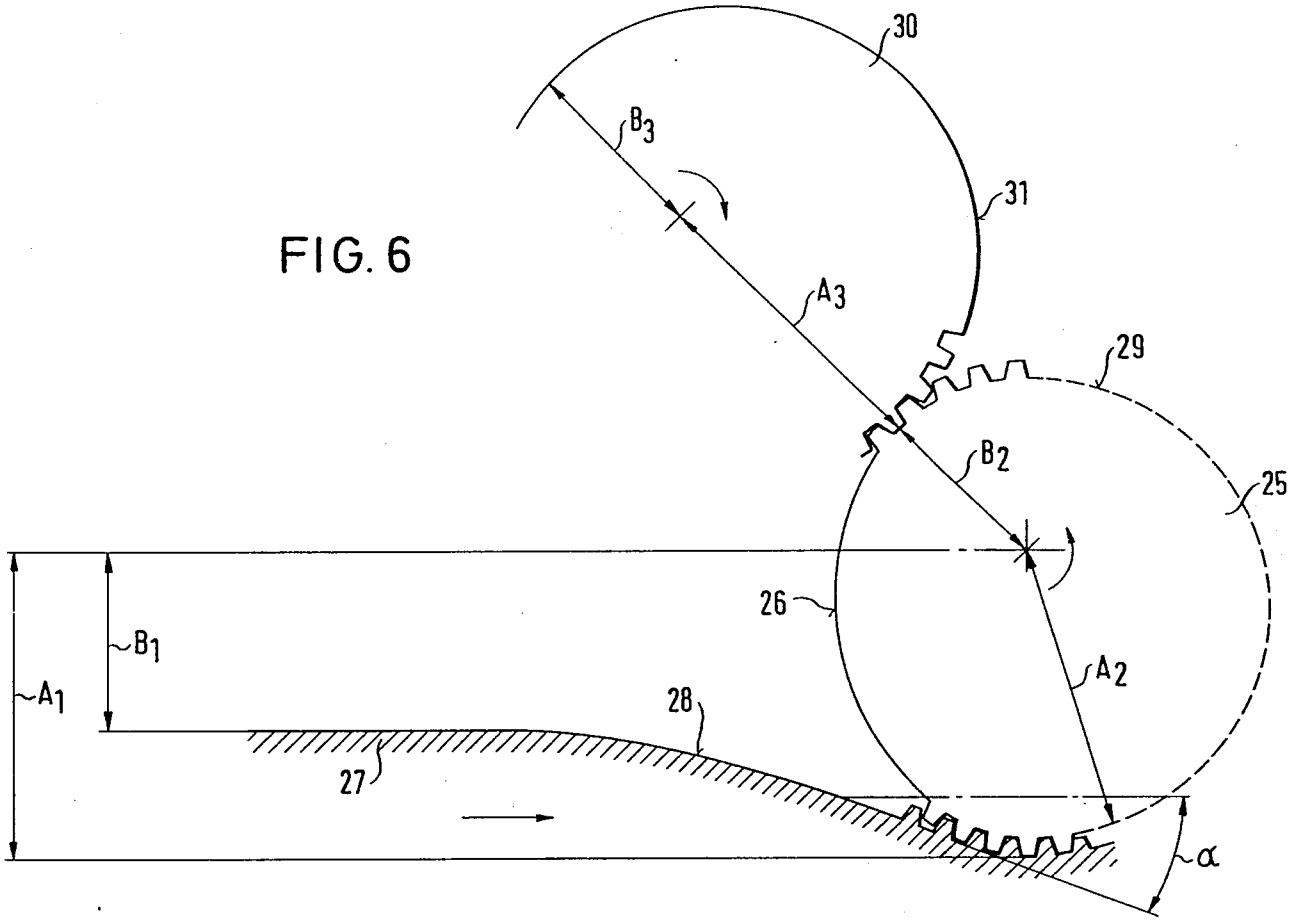
Figure 7:
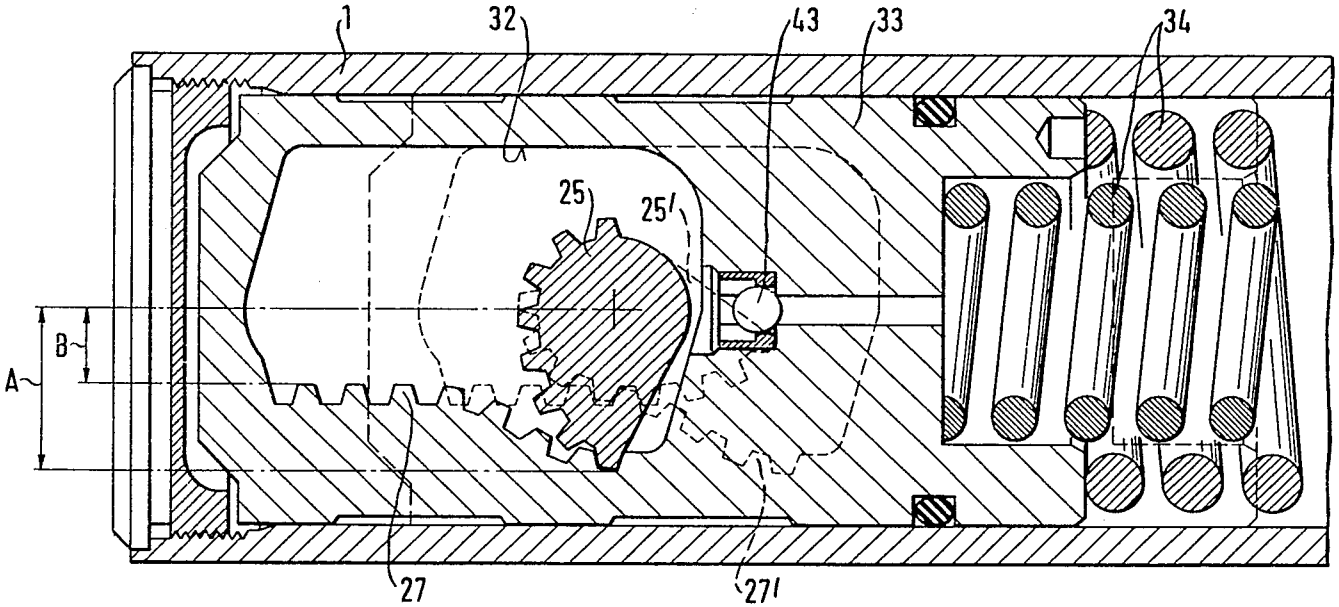
Figure 8:
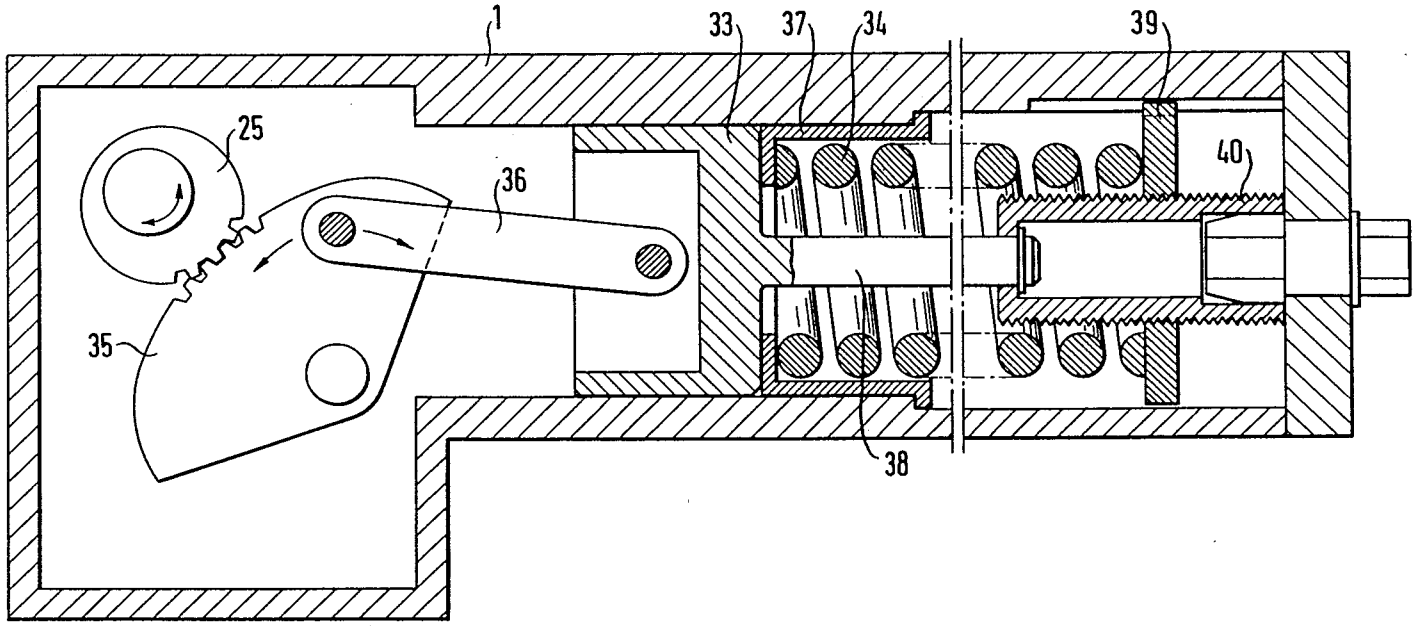
Figure 9:
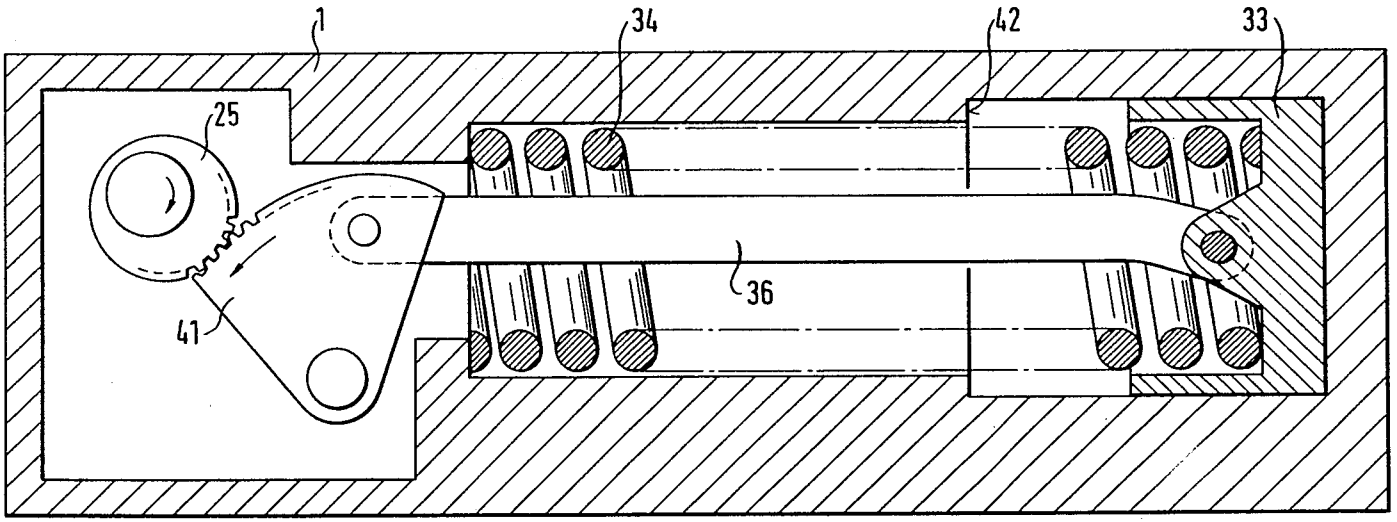

The invention will now be described in the following in more detail with reference to embodiments in conjunction with the drawings which show:

FIG. 1 a schematic longitudinally sectioned illustration of part of a door closer constructed in accordance with the invention, FIG. 2 a representation corresponding to FIG. 1 of a floor-mounted door closer variant, FIG. 3 a schematic longitudinally sectioned respresentation of a further embodiment, FIG. 4 a likewise schematic longitudinally sectioned representation of an embodiment with pistons which are controlled to run in opposite directions, FIG. 5 a schematic representation for explaining the principle of operation of a door closer operating with an eccentric toothed pinion, FIG. 6 a schematic representation to explain an embodiment with a high transmission ratio which is particularly suitable for floor-mounted door closers, FIG. 7 a schematic sectional representation of part of an embodiment of a door closer for mounting at the top of a door, FIG. 8 a schematic representation of part of a floor-mounted door closer for swing doors which is constructed in accordance with the invention, and FIG. 9 a schematic sectional representation of part of a floor-mounted door closer in accordance with the invention which is constructed for rabbeted doors.

As seen in FIG. 1 a double piston arrangement is provided in the housing 1 of a door closer and is formed by an outer piston 5, which is constructed as a ring piston, and by an inner piston 8 which is arranged coaxial to the outer piston 5, which passes through the ring piston and which is guided by the ring piston.

A first compression spring 9 is associated with the outer piston 5 and a second compression spring 10 is associated with the inner piston 8. Both springs are preferably braced against a common abutment, similar for example to the abutment 16 of FIG. 3, which is in particular of adjustable design.

The outer piston 5 is sealed relative to the housing wall by means of a seal 14, while a seal 13 is provided between the outer piston 5 and the inner piston 8.

A synthetic (plastic) sleeve 12 held in the outer piston 5 serves to protect the sliding surfaces.

The outer piston 5 has at least one extension which extends in the direction of the end of the housing opposite to the fixed abutment for the springs 9, 10 and which is constructed as a rack or toothed bar 4. This rack 4 meshes with a gear wheel 3 which is rotationally fixedly connected with the closer axle 2. The lever arm which results between the rack 4 and the closer axle 2 is designated with the letter "a".

A control member 6 which cooperates with a fixed abutment 7 on the inner piston 8, with the fixed abutment 7 being constructed as a roller, is likewise rotationally fixedly connected with the closer axle 2.

The control member 6 has the form of a cam disk with the profile of the cam outer surface which cooperates with the fixed abutment 7 being capable of being selected in accordance with the particular variation of the closing moment with the angle of the door that is required.

In the representation of FIG. 1 the closer is in a position corresponding to a closed door in which the fixed abutment 7 contacts a run-up surface 11 of the control member 6 at which a lever "b" results relative to the closer axle 2. This lever arm "b" can be larger than the lever arm "a" between the gear wheel 3 and the rack 4.

It is evident that both the outer piston 5 and also the inner piston 8 will be displaced against the respective force of the bias springs 9, 10 when the closer axle is rotated in the counter-clockwise sense on opening the respective door blade. The restoring moment which acts on the closer axle 2 is the sum of the individual moments which are exerted from the two pistons 5, 8 via their gear transmission members 3, 4 and 6, 7 respectively.

Whereas, in the illustrated embodiment, the closing moment which originates from the outer piston will increase linearly with increasing angle of opening a second closing moment can be generated by the inner piston 8 via the cam-like control member 6, with the second closing moment being large at small angles of opening and then dropping off in the course of increasing angles of opening, optionally to such a degree that it indeed acts in the opposite sense to the closing moment originating from the outer piston 5 at large angles of opening.

For the practical embodiment of a closer of this kind it is of advantage for the outer piston to be provided with spaced apart double rack projections 4 and for the control member 6 and also the fixed abutment 7 to be located between these two racks, with the inner piston 8 being guided via a support and guide projection 22 on a corresponding guide surface of the racks. In this manner the forces which occur are ideally picked up and signs of wear are minimised.

The variant of the invention shown in FIG. 2 is intended, in the same manner as the embodiment of FIG. 1, for rabbeted doors, is however specially constructed as a floor-mounted door closer.

The control member 6 has in this arrangement a modified outer contour which can generate a negative closing moment in the zone associated with large angles of opening as a result of reduction of the radius and thus of the lever arm. The total moment originating from the outer piston and the inner piston continuous to be positive, however the contribution of the inner piston at larger angles of opening avoids a further increase in the closing moment, which is no longer required, through the compression of the compression spring 9 associated with the outer piston 5.

The so-called k-dimension which should be as small as possible is of particular significance with floor-mounted door closers.

In the embodiment of FIG. 2 it is possible to obtain a particularly small k-dimension in the sideways direction, for which purpose the axle of rotation 2 is disposed so that it lies close to the edge of the closer and in a corner region of the closer, and the closer axle 2 is coupled via a further gear 15 with the transmission elements which cooperate with the outer piston 5 and the inner piston 8 in the manner already described in conjunction with FIG. 1.

In this manner it is possible to achieve a k-dimension of 20 mm, and optionally even less, with a minimum of effort and the substantial advantage of the essentially free determination of the variation of the closing moment characteristic A further embodiment of the invention is shown in FIG. 3 with the same reference numerals as were used in FIGS. 1 and 2 being used in this figure for the same elements.

The difference with this embodiment is the use of a special control member 6 which is no longer executed as a pure cam disk but consists instead of a disk member which is toothed along part of its periphery and which engages in the region of small angles of opening by means of a toothed section in a rack-like extension 17 of the inner piston 8. The disc member moves out of engagement with the rack-like extension 17 beyond a predeterminable angle of opening.

In the embodiment shown in FIG. 4, in which the gear wheel 15 which has to be inserted when using it as a floor-mounted door closer is indicated in broken lines, the outer piston 5 and the inner piston 8 are actuated so that they run in opposite directions. The outer piston 5 is coupled in the already described manner with the closer axle via a gear wheel 3 and a rack 4 and is moved to the right in the drawing when the angle of opening increases.

The inner piston 8 is connected via a rigid or flexible connecting element 21 with an eccentric member 20 which is secured to the gear wheel 3. The connecting element 21 is pivotally connected in this arrangement to the outer region of the eccentric element 20. This pivotal connection is effected in such a way that when the closer axle rotates in the counter-clockwise sense and the door leaf is open, the inner piston 8 is moved in the direction towards the closer axle and thus contrary to the outer piston 5. A compression spring 19 is provided between the outer piston 5 and a piston projection 18 of the inner piston. In this embodiment one compression spring 19 takes on the function of the two previously described compression springs 9, 10.

FIG. 5 shows in schematic manner a gear pinion 25 which is to be connected with a closer axle and which meshes with a toothed arrangement 27 fixed relative to a piston.

The pinion 25 has a rolling curve 26 which consists of a first circular portion with the radius $R_1$, a circular portion which smoothly adjoins the first circular portion and which has the radius $R_2$, and a circular portion which in turn smoothly adjoins the circular portion with the radius $R_2$ and which has the radius $R_3$. The central portion of the roller curve with the radius $R_2$ has the smallest curvature, i.e. the radius $R_2$ is substantially greater than the radii $R_1$ and $R_3$.

In the illustrated schematic representation the rolling curve portion with the smallest radius $R_3$ is in engagement with the toothed portion 27 with the illustrated position corresponding to the opening angle zero of the closer, i.e. the associated door is closed. If the door is opened the spring force acting on the piston and thus on the rack carrying the toothed portion 27 acts via the lever arm A, i.e. a high closing force is available in the region of a small angle of opening. On further opening of the door, i.e. with an increase in the angle of opening, the lever arm reduces in accordance with the selected course of the rolling curve, and indeed reduces to the value B which corresponds to the radius $R_1$ of the rolling curve 26 of the pinion 25. In the illustrated embodiment of FIG. 5 the ratio of A to B is 2 : 1. This ratio corresponds to the transmission ratio which has been achieved. I.e. to the variation in the mechanical advantage which has been achieved.

By suitable selection of the course of the rolling curve 26, which need not necessarily be composed of circular segments, a very flat course of the rolling curve 28 of the toothed portion 27, in achieved, with the flat course corresponding to a small angle of engagement and thus a minimisation of the frictional components acting on the guide wall for the toothed portion 27 .

The maximum angle of engagement in an embodiment corresponding to FIG. 5 is characterised by $\alpha$.

The schematic illustration of principle of FIG. 6 shows an arrangement which is particularly suitable for floor-mounted door closers. In this arrangement an eccentric toothed pinion 30 is connected with the closer axle and meshes with a further rotatably journalled eccentric toothed pinion 25 which in turn engages with a toothed arrangement 27 which is fixedly connected with the piston and is in particular constructed as a rack.

The rolling curve 31 of the eccentric pinion 30 extends relative to the axle of rotation in such a way that the lever arms which are effective relative to the pinion 25 change from the maximum value $A_3$ to the minimum value $B_3$ over the full opening angle of the door closer.

At the pinion 25 a rolling curve 29 is associated with the rolling curve 31 of the pinion 30 and is illustrated in broken lines. This rolling curve extends over half the periphery of the pinion 25. The other half of the periphery of the pinion 25 has a rolling curve 26 which cooperates with the toothed portion 27 and which is in turn associated with the very flatly extending rolling curve 28 of the toothed portion 27. The minimum radius of the pinion 25 which becomes active is designated $B_2$ and the maximum radius which becomes active is designated by $A_2$.

The transmission ratios which come into action due to cooperation of the pinion 25 and the toothed portion 27 are characterised by $A_1$ and $B_1$.

When using this embodiment a particularly favourably k-dimension of for example 20 mm is achieved with it being of particular significance for a floor-mounted door closer that a very high transmission ratio can be achieved despite the very flat extent of the rolling curve 28 of the toothed portion 27. The transmission ratio is determined by the product of the individual ratios, i.e. in the present case by the product $$\frac{A_3}{B_3} \times \frac{A_2}{B_2} \times \frac{A_1}{B_1}.$$

A ratio of for example 4.5 to 1 can be achieved in practice without problem.

It should also be mentioned that the regions of engagement of the toothed pinion 25, i.e. the regions designated in the above as the rolling curves 26, 29 can also overlap.

FIG. 7 shows a partly sectioned representation of a door closer mounted at the top of a door installation and constructed in accordance with the invention.

A piston 33 is arranged in the housing 1 and is biased in the usual way by means of compression springs 34 into the closed position. The piston 33 has a recess or a hollow cavity 32 in its region remote from the springs 34 and an eccentric pinion 25 which is rotationally fixedly connected with the closer shaft is arranged in the hollow cavity 32. This pinion 25 engages with a toothed arrangement 27 which is matched from the point of view of its rolling curve to the corresponding rolling curve of the pinion 25. A non-return valve 43 belonging to the damping device is provided at the spring side in a region of the piston cut-out 32.

The position of the piston 33 shown in continuous lines corresponds to the closed position. In this position the largest lever arm A is effective between the eccentric pinion 25 and the toothed arrangement 27.

If the leaf of the door associated with the closer is pivoted in the opening direction then the piston 33 moves as a result of the cooperation of the pinion 25 and the toothed arrangement 27 into the position shown in broken lines, with the lever arm becoming continually smaller and finally reaching the smallest value B in the position of the pinion and the toothed arrangement designated with 25' and 27'.

In this embodiment the shallow run of the toothed arrangement 27 should be observed which ensures that the friction components between the piston 33 and the housing 1 remain minimal.

FIG. 8 shows an embodiment of the invention in the form of a floor-mounted door closer for swing doors. In this arrangement the eccentric pinion 25 is arranged in a corner region of the housing 1 in order to achieve a construction which is as compact as possible and engages with a toothed segment 35 which is symmetrical about its center. This toothed segment 35 is pivotally connected at the middle and is connected with the piston 33 via a lever 36. The lever 36 is pivotally mounted at both ends.

The piston 33 is provided with a rod 38 which carries an axially adjustable support and guide disk 39 in the region of its end. A compression spring 34 is arranged between this support and guide disk 39 and an abutment sleeve 37 which directly contacts the piston 33. The compression spring 34 is loaded in dependence on the direction of pivotal movement of the associated swing door, and indeed on the one hand via the support and guide disk 39 while being braced on the abutment sleeve 37 and on the other hand via the abutment sleeve 37 while being braced on the support and guide disc 39. The support and guide 39 is secured to an adjustable sleeve 40, which on the one hand displaceably accommodates the piston rod 38 and, on the other hand, can be adjusted in the axial direction from outside of the housing.

The closing force plot, i.e. the way the closing force varies with the angle of opening of the door can in turn be ideally predetermined by selecting the rolling curves for the eccentric pinion 25 and the toothed segment 35.

FIG. 9 shows an embodiment of the invention in the form of a floor-mounted door closer for rabetted doors, i.e. doors which close against a fixed abutment such as a rabett in a door frame.

In this embodiment the eccentric toothed pinion 25 is again arranged in a corner region of the housing and cooperates with an eccentric segment 41 which is pivotably mounted and is connected via a conecting rod with the piston 33. The piston 33 which is of pot-like shape is biased by means of a spring 34 against the end of the housing 1 and is movable between this end and a housing abutment 42. The eccentricities or rolling off curves of the pinion 25 and of the toothed segment 41 can again be selected in accordance with the desired closing force plot.

All embodiments of the invention have in common that they result in a technically simple construction which can be realised economically, with the eccentric elements likewise being capable of being manufactured cheaply. For each special element it is only necessary to manufacture a corresponding broach tool or a corresponding die just once. The compactness of each of the door closers is paired in all embodiments with an ideal plot or variation of the total closing moment which can be adapted in the best possible manner so as to suit the particular application.

We claim:

1. In a door closer comprising a housing; a piston guided in said housing for linear movement therein over a predetermined range; spring means for biasing said piston into an end position, a closer axle; means rotatably journalling said closer axis in said housing; coupling means mechanically coupling said piston to said closer axle and including first and second meshing gears, with said first gear being drivingly coupled to said closer axle and said second gear being drivingly coupled to said piston, whereby rotary movement of said closer axle during door opening produces linear movement of said piston and stressing of said spring means, with the stress of said spring means depending on the position of said piston within said predetermined range; wherein said first gear is an eccentric toothed pinion having a first rolling curve providing a lever arm which varies in dependence on the rotational position of said first gear; wherein said second gear has a second rolling curve complementary to said first rolling curve, and wherein said meshing first and second gears provide a transmission ratio which varies as a result of said varying level arm over said range of linear movement of said piston thereby providing, in conjuction with the instantaneous value of said stress, a predetermined door closing characteristic, the improvement wherein said rolling curve of said eccentric toothed pinion comprises first, second and third curcular portions which merge directly into one another, with each said circular portion having a different respective radius and a different respective origin and with said origins of said circular portions being displaced relative to one another; and wherein said first rolling curve portion is associated with a largest angle of opening of the door closer, has a first radius and is followed by said second rolling curve portion which has a second radius substantially greater than said first radius and which continues said first rolling curve portion, and wherein said third rolling curve portion adjoins and continues said second rolling curve portion, is associated with smaller opening angles of said door closer and has a third radius which is smaller than the radius of said first rolling curve portion.

2. A door closer in accordance with claim 1, wherein said first gear is directly connected to said closer axle.

3. A door closer in accordance with claim 1, wherein said second gear comprises a toothed rack-like extension of said piston.

4. A door closer in accordance with claim 3, wherein said toothed rack-like extension of said piston has an elongated S-shaped rolling curve.

5. A door closer in accordance with claim 3, wherein said piston has first and second opposite ends with said first end coacting with said spring means, wherein a hollow cavity is formed in said second end of said piston and is bounded by wall means of said piston, wherein said toothed rack-like extension is formed on said wall means, and wherein said eccentric toothed pinion is disposed in said hollow cavity and is directly coupled to said closer axle.

6. A door cloer in accordance with any one of the preceding claims, wherein the closer is constructed as a slide arm closer.

* * * * *